US008594360B2

(12) United States Patent
Nishiyama et al.

(10) Patent No.: US 8,594,360 B2
(45) Date of Patent: Nov. 26, 2013

(54) MOUNTING STRUCTURE FOR SPEAKER AND FLAT PANEL DISPLAY

(75) Inventors: Haruyasu Nishiyama, Hyogo (JP); Masao Honda, Hyogo (JP)

(73) Assignee: Fujitsu Limited, Kawasaki (JP)

( * ) Notice: Subject to any disclaimer, the term of this patent is extended or adjusted under 35 U.S.C. 154(b) by 307 days.

(21) Appl. No.: 12/708,963

(22) Filed: Feb. 19, 2010

(65) Prior Publication Data

US 2010/0150390 A1 Jun. 17, 2010

Related U.S. Application Data

(63) Continuation of application No. PCT/JP2007/066234, filed on Aug. 22, 2007.

(51) Int. Cl.
*H04R 1/02* (2006.01)

(52) U.S. Cl.
USPC ..... 381/386; 381/388; 381/391; 181/171; 181/156

(58) Field of Classification Search
USPC ..... 381/386, 388, 391; 181/171, 156
See application file for complete search history.

(56) References Cited

U.S. PATENT DOCUMENTS 4,852,178 A * 7/1989 Inkman et al. ..... 381/395
5,647,007 A * 7/1997 Wooderson et al. ..... 381/332

FOREIGN PATENT DOCUMENTS

JP 52-071519 U 5/1977
JP 6-22013 A 1/1994
JP 9-163481 A 6/1997

OTHER PUBLICATIONS

International Search Report of PCT/JP2007/066234, mailing date of Sep. 25, 2007.

* cited by examiner

*Primary Examiner* — Davetta W Goins
*Assistant Examiner* — Amir Etesam
(74) *Attorney, Agent, or Firm* — Westerman, Hattori, Daniels & Adrian, LLP

(57) ABSTRACT

A mounting structure for a speaker with respect to a panel (1) is provided. The mounting structure includes a speaker (20), a pair of projecting latches (10, 11) flanking a predetermined mounting region of the panel (1), and a frame member (30) which is held in fixed engagement with the latches (10, 11) so as to press the speaker (20) onto the mounting region.

5 Claims, 5 Drawing Sheets

MOUNTING STRUCTURE FOR SPEAKER AND FLAT PANEL DISPLAY

TECHNICAL FIELD

The present invention relates to a mounting structure for a speaker with respect to a panel of e.g. a flat panel display. The present invention also relates to a flat panel display with such a structure.

BACKGROUND ART

A conventional mounting structure for a speaker with respect to a panel is described in Patent Document 1 below. According to the structure described in this document, a speaker is mounted directly to the mounting base on the back surface of a panel by using engagement tabs and grooves or by using screws. Such a mounting structure for a speaker is employed in e.g. a flat panel display of a personal computer.

Patent Document 1: Japanese Lain-open Patent Publication No. H09-163481

However, with the above-described conventional structure, the speaker cannot be completely fixed to the mounting base by the simple engagement of the tabs with the grooves. As a result of such incomplete fixation, undesired chattering noise may be made due to vibrations generated when the speaker produces sounds.

The other mounting structure, in which the speaker is fixed with screws, requires individual tightening for each of the screws. Thus, this structure is disadvantageous in that the speaker mounting process is time-consuming.

DISCLOSURE OF THE INVENTION

The present invention has been proposed under the above-described circumstances. It is therefore an objection of the present invention to provide a speaker mounting structure which enables quick and easy mounting of the speaker without impairing sound quality.

In order to solve the problems described above, the present invention takes the following technical measures.

According to a first aspect of the present invention, there is provided a mounting structure for a speaker to a panel. The structure includes a speaker, a pair of projecting latches flanking a predetermined mounting region of the panel, and a frame member held in fixed engagement with the latches so as to press the speaker onto the mounting region.

Preferably, the speaker may be provided with a cable, and one of the latches may be formed with a longitudinal groove for passing the cable.

Preferably, the speaker may be formed, at corners thereof, with cutout stepped portions, and the frame member may include end portions that are provided with protrusions, openings and edge portions, where the protrusions are held in contact with the stepped portions, the openings allow the passage of the latches, and the edge portions provide an outer enclosure of the openings and are held in contact with engagement portions of the latches.

Preferably, at least a relation $h<d+t$ may be satisfied, where h represents a height from a mounting surface of the panel to the engagement portions of the latches, d represents a thickness of the speaker measured from the mounting surface of the panel to the stepped portions, and t represents a thickness of the frame member in a natural state measured from the protrusions to the edge portions.

Preferably, the mounting structure of the first aspect may further comprise a speaker guide and a frame guide adjacent to the mounting region, where the speaker guide prevents a sidewise displacement of the speaker, and the frame guide prevents a sidewise displacement of the frame member.

According to a second aspect of the present invention, there is provided a flat panel display provided with a speaker mounting structure at an inside of a panel. The flat panel display comprises: a speaker; a pair of projecting latches flanking a mounting region at the inside of the panel; and a frame member held in fixed engagement with the latches for pressing the speaker onto the mounting region.

BEST MODE FOR CARRYING OUT THE INVENTION

Preferred embodiments of the present invention will be described below with reference to the drawings.

Figure 1:
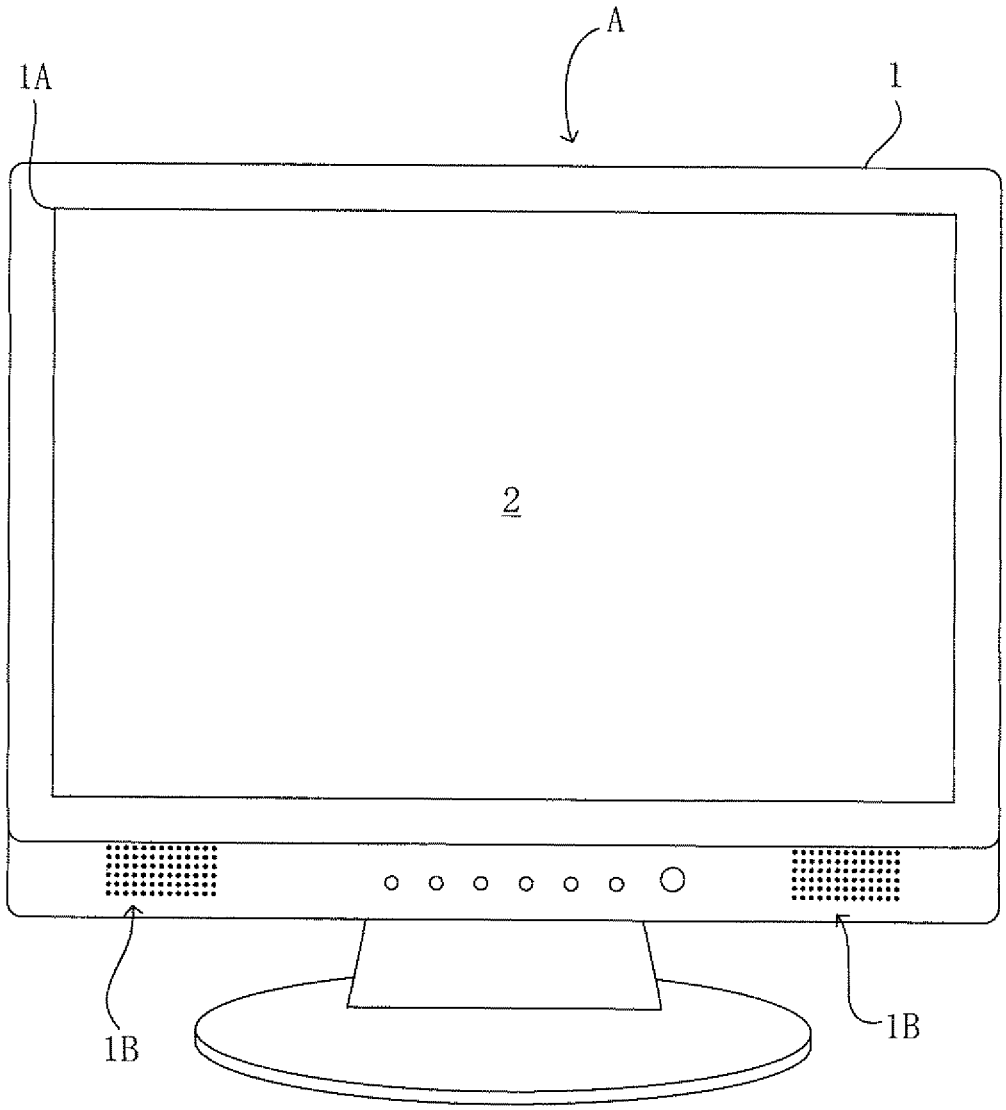
FIG. 1 is an overall view of a flat panel display according to an embodiment of the present invention.

FIGS. 1 through 5 illustrate a speaker mounting structure and a flat panel display according to an embodiment of the present invention. As illustrated in FIG. 1, a flat panel display A of this embodiment includes a front panel 1, a liquid crystal display 2 and one or more speakers 20 (not illustrated in FIG. 1). The liquid crystal display 2 and the speakers 20 are attached to the inside (or rear side) of the front panel 1. The front panel 1 is formed with a display window 1A through which images formed on the liquid crystal display 2 can be seen. The front panel 1 is also formed with a plurality of sound holes 1B for allowing sounds from the speakers 20 to come forward through the panel.

Figure 2:
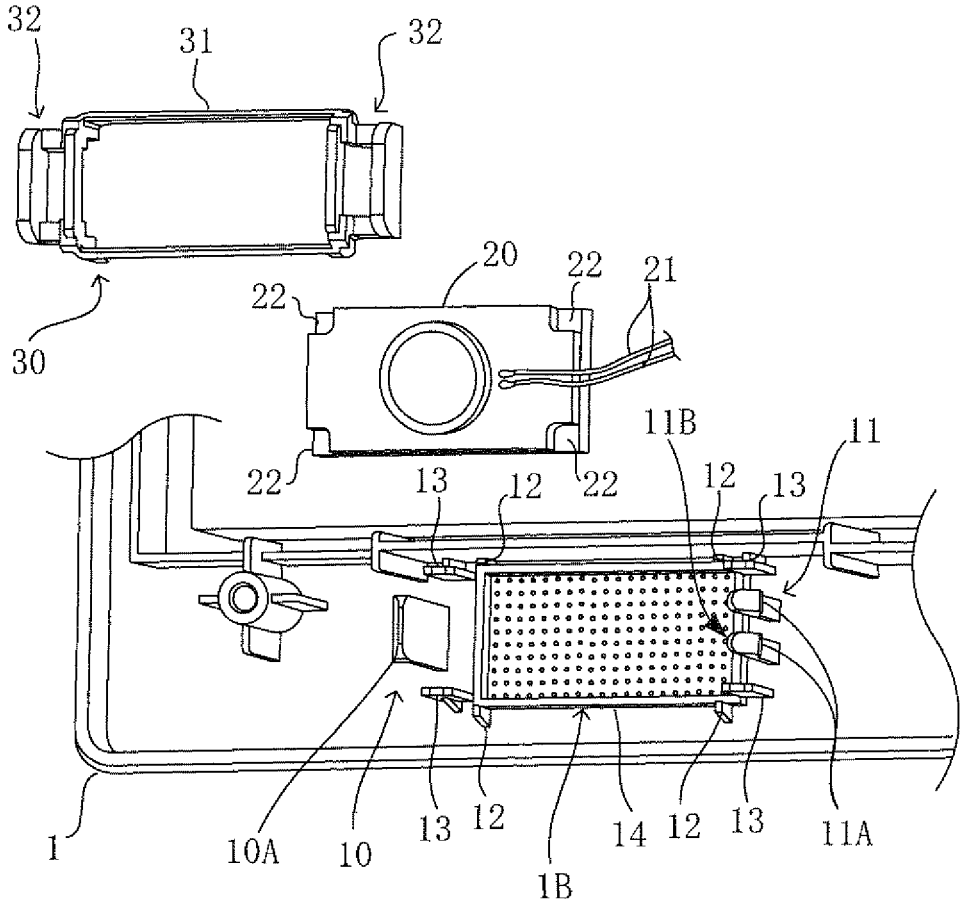
FIG. 2 is an exploded perspective view illustrating a speaker mounting structure for the flat panel display of FIG. 1.
Figure 3:
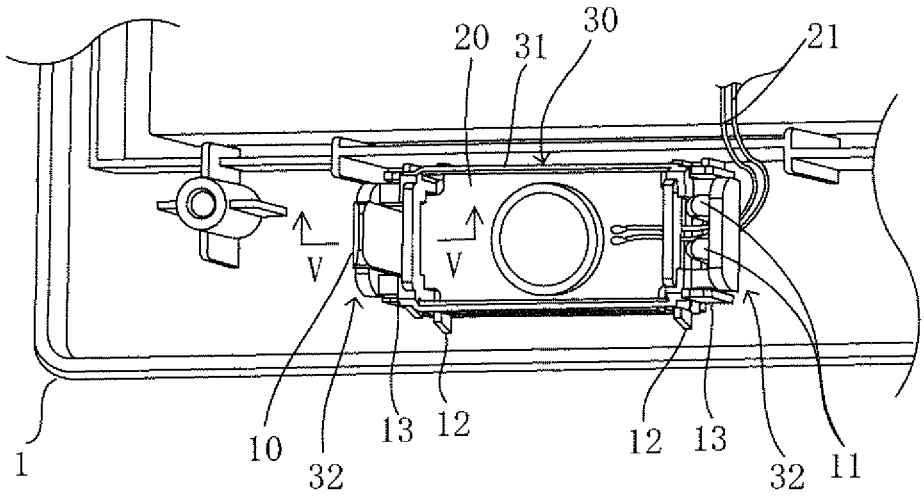
FIG. 3 is a perspective view illustrating the fixed state of the speaker depicted in FIG. 2.

As illustrated in FIG. 2 and FIG. 3, the inside of the front panel 1 is provided with a speaker mounting region that corresponds in position to the sounds holes 1B. The speaker 20, which is rectangular or generally rectangular as a whole, is attached to the speaker fixing section by a frame member 30. Speaker cables 21 are connected to the back surface of the speaker 20. Each of the four corners of the back surface of the speaker 20 is formed with a cutout or stepped portion 22.

Figure 4:
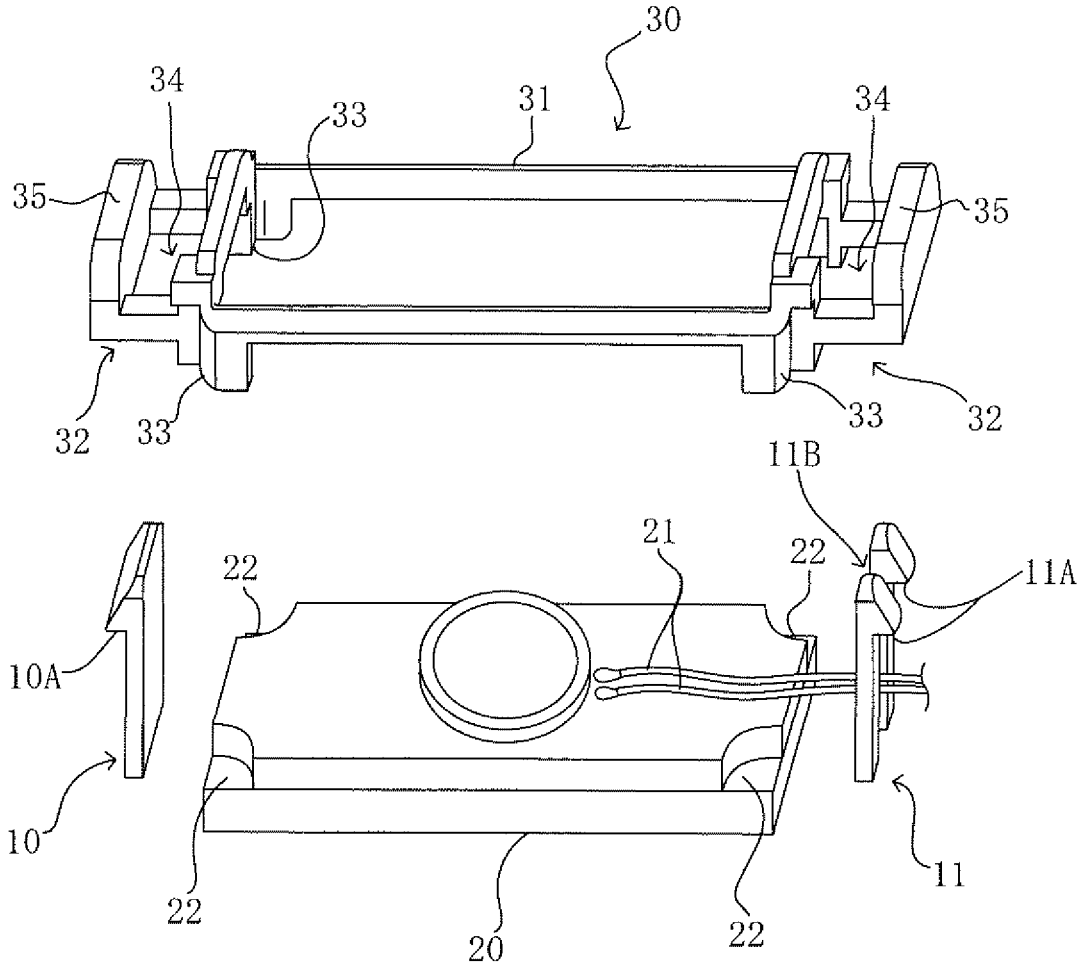
FIG. 4 is an enlarged perspective view illustrating some of the parts depicted in FIG. 2.

As illustrated in FIG. 2 and FIG. 4, a pair of projecting latches 10, 11 for fixing the frame member 30 are provided on the right and left sides of the speaker mounting region so as to flank the region intervening therebetween. As illustrated in FIG. 4, the latch 10 is formed with a hook-shaped engagement portion 10A protruding outwardly. The other latch 11 is also formed with a similar engagement portion 11A. In addition, the latch 11 is formed with a longitudinal groove 11B for allowing the passage of the speaker cables 21. Further, on the periphery of the mounting region, a plurality of speaker guides 12 are provided for making contact with the side surfaces of the speaker 20 and thereby limiting sidewise displacement of the speaker, and a plurality of frame member guides 13 are provided for making contact with the side surfaces of the frame member 30 and thereby limiting the sidewise displacement of the frame member. The mounting region is also provided with a frame-like base 14 which makes contact with the front face of the speaker 20.

As illustrated in FIG. 2 and FIG. 4, the frame member 30 includes a frame portion 31 which has a rectangular shape of similar size to that of the speaker 20, and a right and left end portions 32 spaced from each other in a longitudinal direction of the frame member 30. As illustrated in FIG. 4, each of the end portions 32 of the frame member 30 is formed with downward protrusions 33 each being arranged to come into contact with a corresponding one of the stepped portions 22 of the speaker 20. Further, each end portion 32 is formed with an opening 34 for insertion of the latch 10 or 11, and with an upright end wall having a flat edge portion 35 on top. The upright wall provides an outer enclosure of the opening 34 and the edge portion 35 makes contact with the engagement portion 10A or 11A of the latch 10 or 11. The frame member 30 is made of an elastic material such as plastics, and can deform elastically by an external force in a manner such that the frame portion 31 and the end portions 32 bend like an arch in the longitudinal direction.

Figure 5:
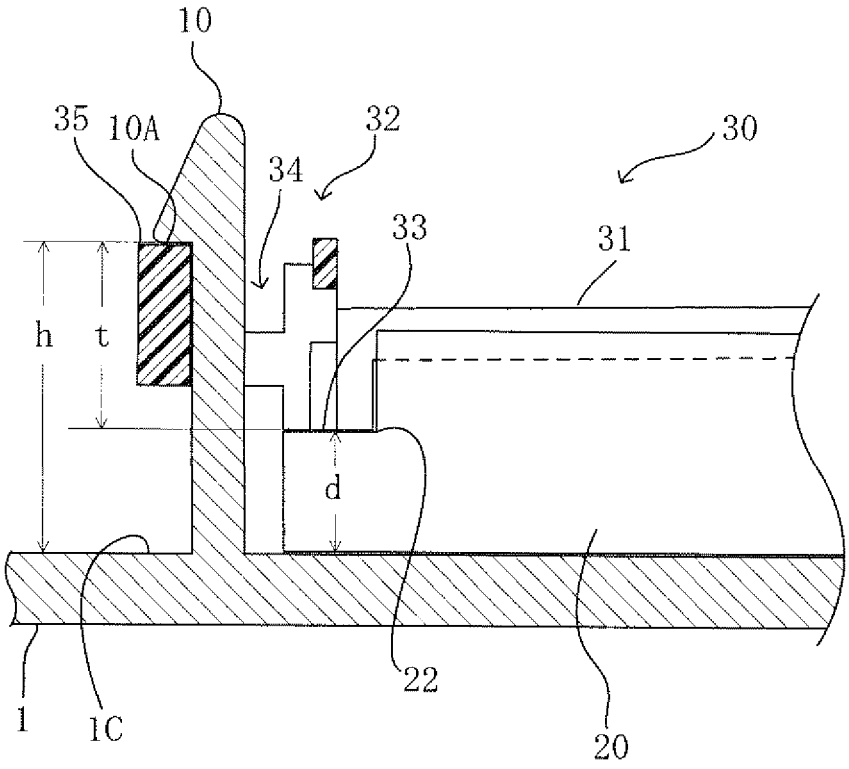
FIG. 5 is a sectional view taken along lines V-V in FIG. 3.

Referring to FIG. 5, suppose that the height from the mounting surface 1C of the front panel 1 to the engagement portion 10A of the latch 10 is "h", the thickness of the speaker 20 measured from the mounting surface 1C to the stepped portion 22 is "d" (this thickness includes the thickness of the frame-like base 14 depicted in FIG. 2), and the thickness of the frame member 30 in its natural state measured from the lower end of the protrusion 33 to the edge portion 35 is "t". The height h, the thickness d and the thickness t are determined to satisfy the relation $h<d+t$. However, if the sum of the thicknesses d and t is too large, it is not possible to engage the frame member 30 with the latches 10, 11 properly. Accordingly, an additional design condition such as $d+t<1.1h$ is also to be applied.

To mount the speaker 20 to the front panel 1, first, the speaker 20 is placed at the mounting region inside the front panel 1 in a manner such that the front surface of the speaker 20 is held in contact with the base 14. At this time, the side surfaces of the speaker 20 are held in contact with the speaker guides 12 so as to prevent sidewise displacement of the speaker 20.

Then, the cables 21 of the speaker 20 are placed into the longitudinal groove of the latch 11, and the frame member 30 is held above the speaker 20. Then, the latches 10, 11 are inserted into the respective openings 34 of the frame member 30 until the engagement portions 10A, 11A come into engagement with the respective edge portions 35. At this time, the side surfaces of the frame member 30 are held in contact with the frame member guides 13, so that sidewise displacement of the frame member 30 is prevented. The cables extend under the frame member 30 and out through the longitudinal groove 11B of the latch 11. The protrusions 33 of the frame member 30 are held in contact with the stepped portions 22 of the speaker 20. Under the above-described condition $h<d+t$, the frame portion 31 and the end portions 32 are slightly arched in the longitudinal direction. As a result, the elastic frame member 30 constantly presses the speaker onto the front panel 1.

As noted above, the mounted speaker 20 is constantly pressed onto the front panel 1 with an elastic force. Thus, the speaker 20 as a whole is not displaced by vibrations. Such reliable mounting prevents the occurrence of chattering noise and eliminates a risk of deterioration of sound quality.

According to the embodiment of the present embodiment, the speaker 20 is mounted firmly by the frame member 30. Thus, no chattering noise is made even upon occurrence of vibrations of the speaker 20 operating to produce sounds, and therefore a clear sound can be reproduced.

The speaker 20 can be attached by a simple procedure and the cables 21 are kept out of the way of the frame member 30. Accordingly, the speaker mounting operation can be performed more quickly and easily than is conventionally possible with use of screws.

The invention claimed is:

1. A speaker mounting structure with respect to a panel, the structure comprising:

a speaker having a quadrilateral shape; a pair of projecting latches flanking a mounting region of the panel and being located at outsides of opposite sides of the quadrilateral shape, the opposite sides being short sides of the quadrilateral shape; and a frame member having a quadrilateral shape and being held in fixed engagement with the latches for constantly pressing the speaker onto the mounting region by end portions of the frame member arched in a longitudinal direction of the frame member, wherein the speaker is formed with cutout stepped portions, the cutout stepped portions are formed at corners of the quadrilateral shape at which sides of the quadrilateral shape cross and are not formed at center portions of the sides of the quadrilateral shape, and the frame member includes end portions that are provided with protrusions, openings and edge portions, the protrusions being held in contact with the stepped portions, the openings allowing passage of the latches, the edge portions providing an outer enclosure of the openings and being held in contact with engagement portions of the latches.

2. The mounting structure according to claim 1, wherein the speaker is provided with a cable, and one of the latches is formed with a longitudinal groove for passing the cable.

3. The mounting structure according to claim 1 or 2, wherein at least a relation h d+t is satisfied, where h represents a height from a mounting surface of the panel to the engagement portions of the latches, d represents a thickness of the speaker measured from the mounting surface of the panel to the stepped portions, and t represents a thickness of the frame member in a natural state measured from the protrusions to the edge portions.

4. The mounting structure according to claim 1 or 2, further comprising a speaker guide and a frame guide adjacent to the mounting region, wherein the speaker guide prevents a sidewise displacement of the speaker and the frame guide prevents a sidewise displacement of the frame member.

5. A flat panel display provided with a speaker mounting structure at an inside of a panel, the display comprising:

a speaker having a quadrilateral shape; a pair of projecting latches flanking a mounting region at the inside of the panel and being located at outsides of opposite sides of the quadrilateral shape, the opposite sides being short sides of the quadrilateral shape; and a frame member having a quadrilateral shape and being held in fixed engagement with the latches for constantly pressing the speaker onto the mounting region by end portions of the frame member arched in a longitudinal direction of the frame member, wherein the speaker is formed with cutout stepped portions, the cutout stepped portions are formed at corners of the quadrilateral shape at which sides of the quadrilateral shape cross and are not formed at center portions of the sides of the quadrilateral shape, and the frame member includes end portions that are provided with protrusions, openings and edge portions, the protrusions being held in contact with the stepped portions, the openings allowing passage of the latches, the edge portions providing an outer enclosure of the openings and being held in contact with engagement portions of the latches.

* * * * *